United States Patent [19]

Herbert et al.

[11] 4,193,253

[45] Mar. 18, 1980

[54] SPINNING POT

[75] Inventors: Werner Herbert, Markdorf; Wunibald Kunz, Friedrichshafen; Klaus Pimiskern, Daisendorf, all of Fed. Rep. of Germany

[73] Assignee: Dornier System GmbH, Friedrichshafen, Fed. Rep. of Germany

[21] Appl. No.: 959,895

[22] Filed: Nov. 13, 1978

[30] Foreign Application Priority Data

Nov. 11, 1977 [DE] Fed. Rep. of Germany ..... 2750456

[51] Int. Cl.[2] ..... D01H 1/12

[52] U.S. Cl. ..... 57/58.89

[58] Field of Search ..... 57/58.89, 58.95

[56] References Cited

U.S. PATENT DOCUMENTS 3,339,360 9/1967 Mikulecky et al. ..... 57/58.89

3,439,487 4/1969 Landwehrkamp et al. ..... 57/58.89

3,520,122 7/1970 Shepherd ..... 57/58.89

FOREIGN PATENT DOCUMENTS 1383194 2/1975 United Kingdom ..... 57/58.89

*Primary Examiner*—Donald Watkins

*Attorney, Agent, or Firm*—Toren, McGeady and Stanger

[57] ABSTRACT

A coating of a thermally hardened alloy of nickel and a nickel-phosphorus compound covers the internal face portions of a spinning pot which are engaged by the fibrous material being spun. The alloy produced from an electroless nickel plating solution is rolled to improve surface smoothness and density, and the rolled coating is heat treated to precipitate a portion of the phosphorus present in the form of a finely dispersed nickel-phosphorus compound. Silicon carbide may be dispersed in the coating to further increase its hardness.

6 Claims, 3 Drawing Figures

SPINNING POT

This invention relates to an open end spinning unit, and particularly to a spinning pot for use in the spinning of yarn from abrasive textile material.

It is common practice to equip spinning machinery with spinning pots which are rotated about an axis and are formed with a cavity of circular cross section about the axis and open in one axial direction. A bottom face of the pot transverse to the axis bounds the cavity in the other axial direction, and an axially extending, annular side face of the pot radially bounds the open, axially terminal part of the cavity and flares from that terminal part inward of the cavity. Respective axial portions of the bottom and side faces converge at an acute angle in a radially outward direction and define the part of the cavity which is of greatest diameter.

When a conventional pot of the afore-described configuration is used for spinning somewhat abrasive fibers, such as Texan cotton or bleached cotton of other origin, the face portions about the widest cavity part suffer relatively rapid erosion so that the pot needs to be replaced after only a few months of operation. The angle of convergence of the bottom and side walls must be chosen carefully for best results according to the fibrous material to be spun, and may be changed significantly in an eroded pot.

Another factor that needs to be controlled closely for proper spinning action is the microscopic configuration of the pot surface in contact with the fibers. That surface must be relatively smooth, but it must not show a mirror polish, and the surface finish should not be affected by contact with the fibers over an extended period.

Attempts at improving the useful life of spinning pots by coating the inner walls of a steel or aluminium pot with various materials did not succeed because the necessary combination of hardness or abrasion resistance and controlled surface roughness could not be achieved in a reproducible manner, until we found that coatings of electroless nickel, when cold rolled and thereafter heat treated, extended the life of spinning pots in a manner not heretofore available, and that the necessary conditions could be maintained readily.

Figure 1:
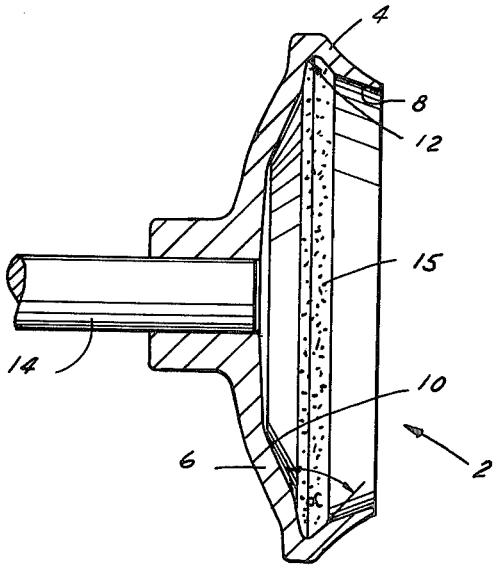
Figure 2:
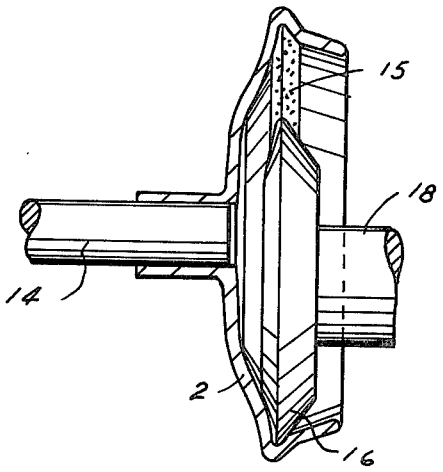

Other features and the attendant advantages of this invention will readily be appreciated as the same becomes better understood from the following detailed description of preferred coating methods and of the resulting products when considered in connection with the appended drawing in which:

FIG. 1 shows a spinning arrangement of the invention in fragmentary section on its axis of rotation; and FIG. 2 illustrates a step in the preparation of the spinning arrangement of FIG. 1 in a corresponding manner.

Referring initially to FIG. 1, there is shown a spinning pot 2 consisting mainly of a side wall 4 and a bottom wall 6. Respective faces 8, 10 of the walls 4, 6 define a cavity of circular cross section about an axis, the cavity being axially open in a direction away from the bottom face 10. The side face 8 flares from the axially terminal, open part of the pot cavity inward of the cavity, and respective axial portions of the bottom and side faces converge at an acute angle $\alpha$ in a radially outward direction and define the widest part 12 of the cavity. A coaxial drive shaft 14 fixedly fastened to the bottom wall 6 rotates the pot 2 about its axis during spinning as is known in itself.

The spinning arrangement described so far does not significantly differ from known spinning pots. The pot is a unitary piece of aluminium which carries a coating 15 of cold-worked and heat treated electroless nickel at least on those portions of the faces 8, 10 which bound the widest part 12 of the pot cavity and immediately adjacent axial face portions.

The nature of the coating and its preparation will be illustrated by the following examples.

EXAMPLE 1

A spinning pot of aluminium was immersed in a proprietary, electroless nickel plating solution (Kanigen, a trademark of the General American Transportation Corp.) having a nominal composition of 23 g/l nickel sulfate hexahydrate, 30 g/l sodium hypophosphite, 50 g/l complexing agent and buffer, and 2 mg/l stabilizer, and a pH of 4.6. The pot was kept immersed in the solution at 94° C. for about 20 minutes, and a coating about 50 $\mu$m thick formed on the surfaces.

After being rinsed and dried, the coated pot was mounted on the shaft 14, and the shaft was slowly turned in a lathe while a shaping disk 16 turned by a shaft 18 spacedly parallel to the shaft 14 was turned in the pot cavity at a circumferential velocity slightly greater than that of the cavity portion 12, as is shown in FIG. 2. The edge of the disk 16 conformed to the portions of the faces 8, 10 at and immediately adjacent the cavity portion 12 and was pressed radially against the face portions, thereby rubbing against the surface of the coating 15. Continued rolling and rubbing engagement between the disk 16 and the coating 15 caused gradual smoothing of the latter, and rolling was interrupted when a desired surface finish was achieved.

Contact of the coating with the hardened tool steel of the disk 16 produced a smoothing action of the coating which was readily observed under the microscope.

The rolled pot then was removed from the shaft 14 and held at 290° C. for three hours to precipitate a finely dispersed phosphorus rich phase from a matrix of nickel containing less phosphorus. While there is extensive literature on electroless nickel, and many patents in this field are assigned to GENERAL AMERICAN TRANSPORTATION CORP., the exact nature of the dispersed nickel-phosphorus compounds is not exactly known to us. The coating produced in this Example had a microhardness of 1100 kp/mm$^2$ (Rockwell C 72).

A coating thickness of 50 $\mu$m was adequate for extending the service life of a spinning pot to several times the life of the uncoated pot, but as little as 20 $\mu$m of the alloy of nickel and nickel-phosphorus compound greatly improved pot performance. Greater thicknesses increase the service life at a diminishing rate, and little is achieved by making the coating thicker than 80 $\mu$m.

EXAMPLE 2

Pot coatings even more abrasion resistant than could be prepared by the method of Example 1 were obtained from electroless nickel plating solutions containing finely dispersed, very hard particles. A plating solution differing from the solution described in Example 1 by containing approximately 10 g/l silicon carbide is commercially available (Kanisil 2000, General American Transportation Corp.) and was employed in a procedure differing otherwise from that described in Example 1 only by the use of a hard metal disk instead of the tool steel disk 16.

The thermally hardened coating had an overall hardness of 1400 kp/mm$^2$, the dispersed, embedded silicon carbide particles having a hardness of about 2600 kp/mm$^2$, and the alloy matrix the same hardness of 1100 kp/mm$^2$ that was found in the product of Example 1.

The dispersed silicon carbide particles do not interact chemically with the other components of the nickel plating solution, and analogous results were achieved with other chemically inert, hard materials, such as the carbides of boron, titanium, zirconium, and tungsten. Aluminium oxide, though almost equally hard, was less advantageous than the carbides. Varying the amount of silicon carbide in the nickel plating solution between 5 and 15 g/l did not materially affect the outcome.

It should be understood, of course, that the foregoing disclosure relates only to presently preferred embodiments, and that it is intended to cover all changes and modifications of the examples of the invention herein chosen for the purpose of the disclosure which do not depart from the spirit and scope of the invention set forth in the appended claims.

What is claimed is:

1. In a spinning arrangement, in combination:

(a) a spinning pot having an axis and formed with a cavity of circular crosssection about said axis, (1) said pot having a bottom face transverse to said axis and axially bounding said cavity, and an axially extending, annular side face radially bounding an axially terminal part of said cavity open in a direction away from said bottom face, (2) said side face flaring from said terminal part inward of said cavity, (3) Respective axial portions of said bottom and side faces converging at an acute angle in a radially outward direction and defining a part of said cavity of greatest diameter; and (b) a coating of a thermally hardened alloy of nickel and a nickel-phosphorus compound covering at least said portions of said faces and having a surface exposed in said cavity, (c) a shaping disk is turned in the cavity of the pot in rolling engagement between the disk and the coating, producing a smoothing of said coating.

2. In an arrangement as set forth in claim 1, the hardness of said alloy being at least 1000 kp/mm$^2$ (70 Rockwell C).

3. In an arrangement as set forth in claim 1, the thickness of said coating being between 20 and 80 $\mu$m.

4. In an arrangement as set forth in claim 3, said coating including particles of a harder material finely dispersed in said alloy, said harder material being a carbide of an element selected from the group consisting of silicon, boron, titanium, zirconium, and tungsten.

5. In an arrangement as set forth in claim 3, said harder material being silicon carbide.

6. In an arrangement as set forth in claim 1, a rotatable shaft coaxially mounted on said pot in driving relationship.

* * * * *